US007201613B2

(12) United States Patent
Sasaki

(10) Patent No.: US 7,201,613 B2
(45) Date of Patent: Apr. 10, 2007

(54) PRESSURE CONTACT HOLDING-TYPE CONNECTOR

(75) Inventor: Yuichiro Sasaki, Shiojiri (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 0 days.

(21) Appl. No.: 10/549,153

(22) PCT Filed: Mar. 16, 2004

(86) PCT No.: PCT/JP2004/003476

§ 371 (c)(1),
(2), (4) Date: Apr. 13, 2006

(87) PCT Pub. No.: WO2004/084356

PCT Pub. Date: Sep. 30, 2004

(65) Prior Publication Data

US 2006/0172613 A1 Aug. 3, 2006

(30) Foreign Application Priority Data

Mar. 18, 2003 (JP) ..... 2003-073769

(51) Int. Cl.
*H01R 13/24* (2006.01)

(52) U.S. Cl. ..... 439/700; 439/824

(58) Field of Classification Search ..... 439/700, 439/824

See application file for complete search history.

(56) References Cited

U.S. PATENT DOCUMENTS 5,727,954 A * 3/1998 Kato et al. ..... 439/66
6,663,439 B2 * 12/2003 Henry et al. ..... 439/700
6,743,043 B2 * 6/2004 Yamada ..... 439/482
6,814,626 B2 * 11/2004 Wen-Yao ..... 439/700
6,844,749 B2 * 1/2005 Sinclair ..... 324/761
6,866,519 B2 * 3/2005 Fan et al. ..... 439/66
6,951,489 B2 * 10/2005 Sekiguchi ..... 439/700
2003/0006787 A1 * 1/2003 Kazama ..... 324/754
2004/0077225 A1 * 4/2004 Chun-Fu ..... 439/700
2005/0266734 A1 * 12/2005 Kazama ..... 439/700

FOREIGN PATENT DOCUMENTS

| | | |
|---|---|---|
| JP | 58-49590 | 3/1983 |
| JP | 63-150474 | 6/1988 |
| JP | 7-161401 | 6/1995 |
| JP | 11-37131 | 2/1999 |
| JP | 2002-100431 | 4/2002 |
| JP | 2002-158052 | 5/2002 |
| JP | 2002-158053 | 5/2002 |
| JP | 2002-246132 | 8/2002 |
| JP | 2002-340930 | 11/2002 |

* cited by examiner

*Primary Examiner*—Hae Moon Hyeon
(74) *Attorney, Agent, or Firm*—Wenderoth, Lind & Ponack, L.L.P.

(57) ABSTRACT

A pressure contact holding-type connector in accordance with the present invention is configured to be interposed between opposing electrodes. A conductive pin is located in at least one end portion of each through-hole of an insulating housing having a through-hole oriented in a thickness direction. A flange section provided on the conductive pin is mated with a small-diameter section provided in one end portion of the through-hole to maintain at least part of the conductive pin in a state of accommodation inside the through-hole. And, a conductive coil spring having one end thereof mated with the flange section provided on the conductive pin and pushing the conductive pin with a snap to an exterior of the through-hole is installed inside the through-hole. The conductive pin can be disposed at both ends of the coil spring.

20 Claims, 8 Drawing Sheets

PRESSURE CONTACT HOLDING-TYPE CONNECTOR

TECHNICAL FIELD

The present invention relates to a pressure contact holding-type connector, and more particularly to a pressure contact holding-type connector in which a conductive pin of the connector does not slip out of a housing.

BACKGROUND ART

Connector pins for electric connection are known as structure for conductively connecting, via elastic contact, and providing signal transfer between electronic circuits on a pair of boards disposed opposite each other in a variety of electronic devices (see Japanese Patent Application Laid-open No. H7-161401). Furthermore, the inventor suggested pressure contact holding-type connectors with improved connector pins for electric connection (Japanese Patent Applications Laid-open No. 2002-100431, 2002-158052, and 2002-158053).

A connector pin for electric connection (Japanese Patent Application Laid-open No. H7-161401) is described, as shown in FIG. 10, as a connector 46 for electric connection, comprising: a connector pin 43 that is extendably and slidably fitted into a tubular body 41, locked inside thereof, and impelled in an extending direction by a spring 42 located inside the tubular body 41 and providing for electric conduction between the connector pin 43 and tubular body 41 via a sliding contact section of an outer peripheral surface 44 of a mating section of the connector pin 43 and an inner peripheral surface 45 of the tubular body 41 in a contracted state of the connector pin 43, wherein a small-diameter relief section 47 is provided over a wide area, except two end sections in an axial direction, at the outer peripheral surface 44 of the mating section of the connector pin 43.

In the connector for electric connection shown in FIG. 10, because a contact terminal is inserted into a board and fixed therein by soldering, there is a not-insignificant risk of degrading assemblability. Furthermore, because the tubular body 41 is used, a diameter of the connector pin 43 increases and also connector pins 43 are difficult to arrange with a fine pitch (for example, at most 1.2 mm).

A pressure contact holding-type connector (Japanese Patent Application Laid-open No. 2002-158053), in which the connector pin for electric connection was improved is a pressure contact holding-type connector 54 comprising, as shown in FIG. 11, an insulating housing 48, a plurality of through-holes 49 provided in a thickness direction of the housing 48, nearly cap-like conductive toe-pins 50 slidably fitted from one surface side of the housing 48 into each through-hole 49, conductive pins 51 slidably fitted from another surface side of the housing 48 into the through-holes 49 and also fitted into the conductive toe-pins 50, and springs 53 fitted into each through-hole 49, brought into contact with open end sections 52 of the conductive toe-pins 50, and passing through to the conductive pins 51, wherein the conductive toe-pins 50 and conductive pins 51 are caused to protrude from the housing 48 by a thrusting force of the spring 53.

This pressure contact holding-type connector shown in FIG. 11 can be mounted onto an electronic circuit board itself. End portions of the conductive pins comprising pins using, for example, gold-plated conductive copper, brass, aluminum, or conductive elastomer, are formed to have a shape sharpened at a prescribed angle or a pointed shape of a cone, pyramid, or the like, so that they can break an oxide film present on solder of electrodes that are to be connected, thereby enabling good conduction. Furthermore, because the conductive toe-pins 50 and conductive pins 51 are always in direct contact and form a shortest conduction path, a conduction path is reduced, inductance can be greatly decreased, and a high frequency characteristic can be realized. In addition, an entire length of the conductive pins 51 can be reduced. However, because the conductive toe-pins 50 and conductive pins 51 are in sliding contact on peripheral surfaces thereof, a pressure force necessary to provide for conduction between electrodes increases. Furthermore, because the conductive pins 51 pass through inside a coil of the spring 53 in a locked state, a stroke of the conductive pins tends to be relatively small by comparison with an entire length of the spring.

In a modification-example of the pressure contact holding-type connector of this type (Japanese Patent Application Laid-open No. 2002-158053), which is not shown in the figures, a conductive pin is provided with a flange section, which is engaged with a small-diameter section of a housing to prevent the conductive pin from slipping out of the housing.

A pressure contact holding-type connector of another type in which the connector pin for electric connection was improved (Japanese Patent Application Laid-open No. 2002-100431) is a pressure contact holding-type connector 55 that is to be interposed and held between opposing electrodes, wherein conductive spring elements 60 formed to have a nearly conical shape are fitted into through-holes 56 of an insulating housing 57 having a plurality of through-holes 56 oriented in a thickness direction. A diameter of at least one end portion of a spring element is formed larger than a diameter of other end portions, a cap 58 is mounted on a large-diameter end portion, a plug 59 is mounted on a distal end, and the spring element is provided so as to protrude from a surface of the housing 57 at a side of the other end portions. Electric conduction is ensured from the plug 59, that is in contact with one electrode, to the cap, that is in contact with another electrode, via spring element 60 that has good conductivity.

In the pressure contact holding-type connector of this type, a length of the plug 59 can be decreased by mating an end portion of the spring element 60 with a toric neck section provided in the plug 59, and almost an entire length of the spring element 60 can serve as a stroke for the plug 59. Another specific feature is because the connector has no sliding contact sections with surface contact, a pushing force necessary to move the plug 59 back and forth can be reduced.

However, in the pressure contact holding-type connector of this type, because a rather large portion of the spring element 60 protrudes from the housing 57, this extending portion can be extended or deformed by an inadvertently applied external force during mounting, transportation or maintenance, or the plug 59 fitted into the spring element 60 can separate from the spring element 60.

SUMMARY OF THE INVENTION

The present invention further improves the pressure contact holding-type connector shown in FIG. 12, and it is an object thereof to provide a pressure contact holding-type connector in which deformation of the spring element and separation of the plug from the spring element, and damage of the plug, are prevented.

The pressure contact holding-type connector in accordance with the present invention is a pressure contact holding-type connector to be interposed and held between opposing electrodes, wherein, in order to resolve the above-described problems: a conductive pin is located in at least one end portion of each through-hole of an insulating housing having the through-hole oriented in a thickness direction; a flange section provided at the conductive pin is mated with a small-diameter section provided in one end portion of the through-hole to maintain at least part of the conductive pin in a state of accommodation inside the through-hole; and a conductive coil spring, having one end thereof mated with the flange section provided at the conductive pin and pushing the conductive pin with a snap to an exterior of the through-hole, is installed inside the through-hole. The conductive pin can be disposed at both ends of the coil spring.

Furthermore, it is preferred that an end stopper for preventing excess compression be provided between the housing and a circuit board or electronic component that is electrically connected by the pressure contact holding-type connector, that the coil spring be formed to have a shape with respectively different coil diameters in adjacent turns, that any corner on a lower side of the housing be chamfered, that a rib for preventing solder from wrapping-around be provided at a rear surface of the housing between disposed conductive plates, and that corner portions of the flange section of the conductive pin be rounded.

The present invention eliminates a risk of the connector, in particular the coil spring, being damaged or deformed. Furthermore, a load required for pushing can be decreased, stable connection can be provided, damage to electrodes that are connected can be significantly reduced, and further miniaturization of the connector is attained.

BRIEF DESCRIPTION OF THE DRAWINGS

FIGS. 2A–2C illustrate an external appearance of the embodiment of the pressure contact holding-type connector in accordance with the present invention; wherein FIG. 2A is a plan view (top view), FIG. 2B is a front view (vertical view), and FIG. 2C is a rear view;

FIGS. 3A–3C are explanatory drawings illustrating another embodiment of the pressure contact holding-type connector in accordance with the present invention; wherein FIG. 3A is a plan view (top view), FIG. 3B is a front view (vertical view) with a partial cross section, and FIG. 3C is a side view;

FIGS. 5A–5D are explanatory drawings illustrating a third embodiment of the pressure contact holding-type connector in accordance with the present invention; wherein FIGS. 5A and 5C are front (vertical) explanatory drawings illustrating a state prior to mounting, and FIGS. 5B and 5D are front (vertical) explanatory drawings illustrating a state during mounting;

DETAILED DESCRIPTION OF THE PREFERRED EMBODIMENTS

The present invention is based on accommodating a spring element inside a through-hole provided in a housing.

The present invention will be described below in greater detail with reference to the appended drawings.

Figure 1:
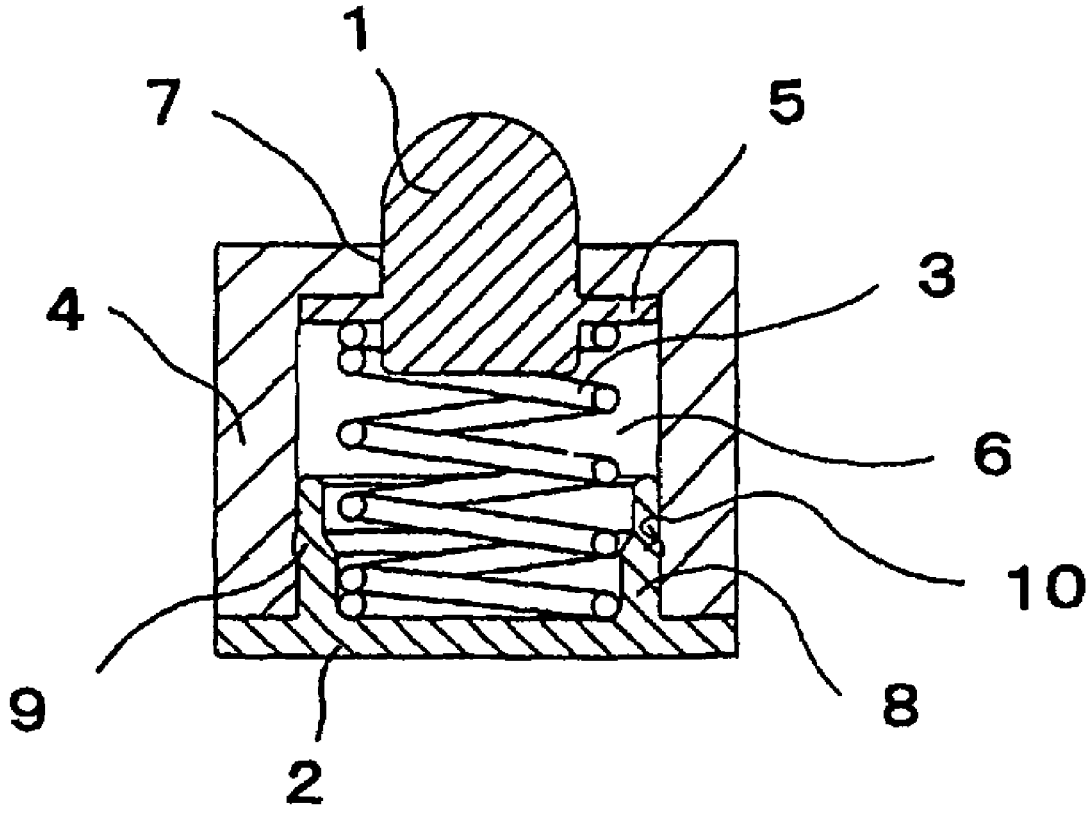
FIG. 1 is a cross-sectional view illustrating an embodiment of a pressure contact holding-type connector in accordance with the present invention.

In FIG. 1, reference numeral 1 stands for a conductive pin, 2—a conductive plate, 3—a coil spring, and 4—an insulating housing. A flange section 5 is formed on the conductive pin 1, and a through-hole 6 is formed in the housing 4. One end of the through-hole 6 is a small-diameter section 7. The flange section 5 of the conductive pin 1 accommodated inside the through-hole 6 of the housing 4 mates with a step of a portion of the small-diameter section 7 of the through-hole 6, thereby preventing the conductive pin 1 from being separated and from slipping out of the housing 4. A head section of the conductive pin 1 can protrude from the housing 4.

Another end side of the housing 4 is enclosed with the conductive plate 2. A cylindrical section 8 of a diameter corresponding to the through-hole 6 of the housing 4 is provided on the conductive plate 2, and the cylindrical section 8 is press fitted into the through-hole 6 of the housing 4. It is preferred that a protruding section 9 provided on an outer periphery of the cylindrical section 8 engage with a mating recess 10 provided on an inner wall of the through-hole 6 of the housing 4 and be fixed therein.

If necessary, a linear section 11 can be provided on the conductive plate 2, as shown in FIG. 2(*c*), thereby enabling engagement with a positioning projection 12, which can be provided on a rear surface of the housing 4, and alignment of a direction of insertion into the housing 4 with a desired direction.

An inner wall of the cylindrical section 8 has a small-diameter section at a bottom part thereof, and one end of the coil spring 3 is mated therewith and mounted in a fixed condition thereon. Further, another end of the coil spring 3 is mated with the flange section 5 of the conductive pin 1 with a snap, thereby applying a pressure in a direction of separating the conductive pin 1 and the conductive plate 2.

In the example shown in FIG. 2, a bottom surface of the conductive plate 2 has a shape with a diameter equal to a width of the housing 4 and both sides cut along arcs, but this shape is not limiting and any appropriate bottom surface can be used, provided that a size and shape thereof are such that it mates with the housing 4 and does not sink into the through-hole 6. For example, the bottom surface may have a round shape with a diameter smaller than the width of the housing 4.

The conductive pin 1 and conductive plate 2 are brought into contact with electrodes of electronic parts or a circuit board and are conductively connected between the electrodes.

The conductive pin 1 is fabricated by using, for example, gold-plated copper or a copper alloy such as brass, or a conductive elastomer. Furthermore, a head section of the conductive pin can have an appropriate shape, for example, a flat, semispherical, or conical shape, and a cross-sectional shape thereof may be round, angular, elliptical or oval. If it is in the form of a plurality of small cones or small pyramids, then when connection is made between electronic circuit boards, in particular, when the electrodes have been plated with solder, an oxide film of the solder is broken and reliable electric conduction is possible.

The conductive plate can be fabricated from the same material as the conductive pin. The cylindrical section provided on the conductive plate may be formed integrally with the conductive plate or may be formed separately and joined by an appropriate method, for example, by soldering or with a conductive adhesive.

The coil spring is formed as a resilient coil with a nearly cylindrical shape by winding a fine metal wire with a diameter, for example, 30–200 μm, preferably 50–100 μm with a uniform pitch (for example, 0.4 mm). A metal wire, for example, from phosphorus bronze, copper, beryllium copper, spring steel, hard steel, stainless steel, or piano wire or a metal wire obtained by plating those metallic wires with gold, can be used as the fine metal wire for forming the coil spring.

From a standpoint of conduction resistance, it is preferred that a copper alloy with a small volume resistivity be used so that the coil spring forms a conduction path, but because resilient properties of such an alloy are insufficient, brass, spring steel, stainless steel, and piano wire, which have a large modulus of elasticity, are recommended.

However, all those materials have a volume resistivity and conduction resistance higher than copper alloys. Therefore, for applications requiring a low conduction resistance, those wires are preferably plated with a thick layer (1–10 μm, preferably 3–5 μm) of a metal with a low volume resistivity, such as copper.

Furthermore, a gold layer is preferably plated as an outermost surface layer to decrease contact resistance. In this case, a nickel plating layer (2–3 μm) for diffusion prevention may be provided between the plated copper laying and gold plating layer.

The diameter of fine metal wire is selected within a range of 50–100 μm because low-load connection and low cost can be readily accomplished.

Figure 2A:
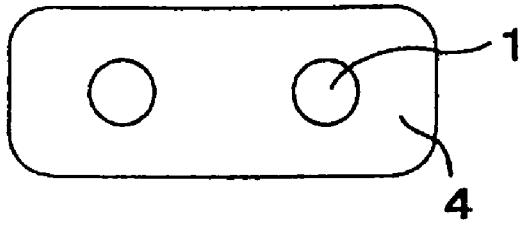
Figure 2B:
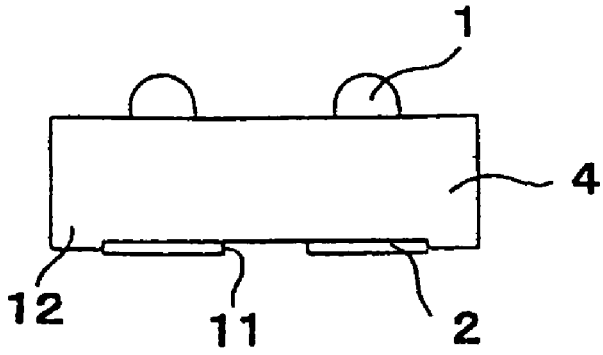
Figure 2C:
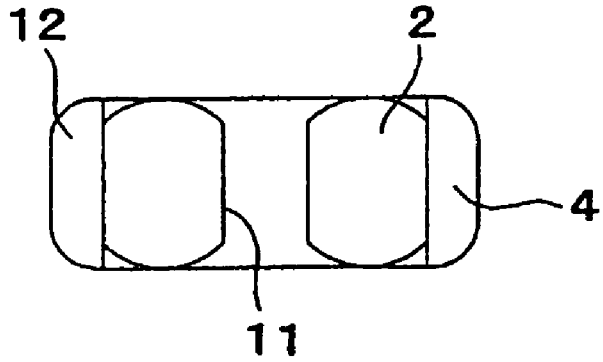

The housing can be formed to have a rectangular, square, polygonal, elliptical or oval profile. The housing may be provided with one through-hole, a plurality of through-holes arranged in one row, or a plurality of rows of through-holes arranged parallel to each other. Individual through-holes may also be arranged in a zigzag fashion in a plane. FIGS. 2A–2C illustrate a case where two through-holes are arranged in one row.

The insulating housing is formed by using a plastic for general applications that excels in terms of heat resistance, dimensional stability, and moldability (for example, a polyamide resin, a polycarbonate, polypropylene, polyvinyl chloride or polyethylene). Among those materials, a polyamide resin is most preferred from a standpoint of processability and cost.

Another embodiment of the present invention will be described below. In the present embodiment, conductive pins are provided on both sides.

Figure 3A:
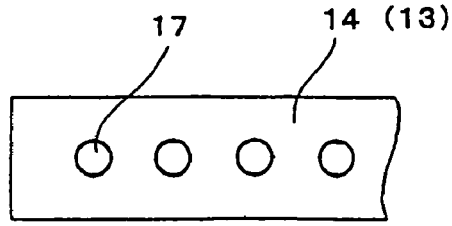
Figure 3B:
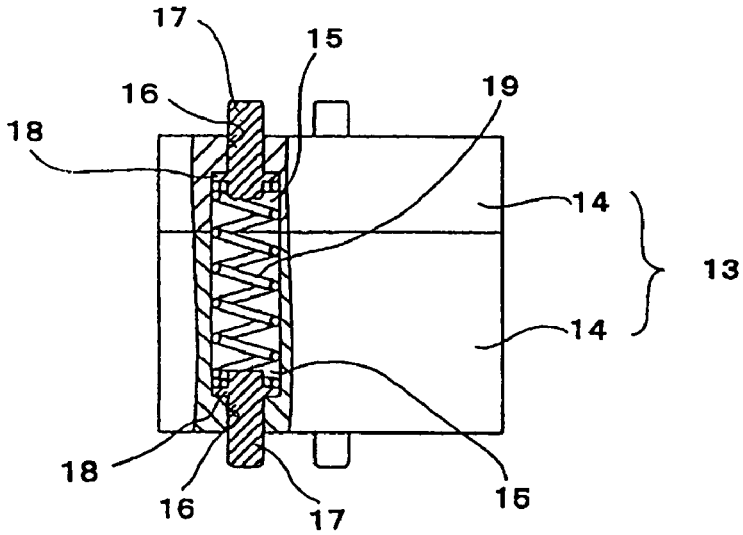
Figure 3C:
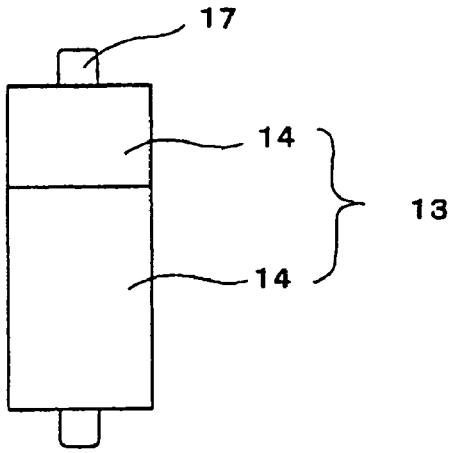
Figure 4:
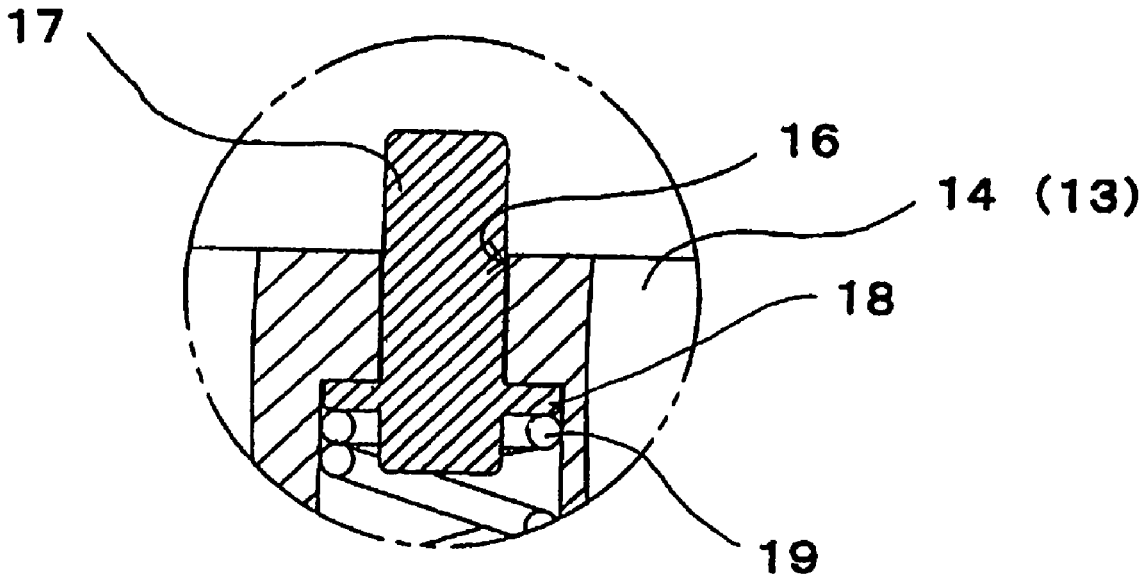
FIG. 4 is an enlarged cross-sectional view of a main portion shown in FIGS. 3A–3C.

Referring to FIGS. 3A–3C, a housing 13 comprises two housing plates 14, 14 and through-holes 15, 15 are formed in the housing plates 14, 14, respectively. One end section of the through-holes 15, 15 is a small diameter section 16. Flange sections 18 of conductive pins 17, 17 accommodated inside the through-holes 15, 15 of the housing 13 (housing plates 14, 14) mate with steps of portions of the small-diameter sections 16, 16 of the through-holes 15, 15, thereby preventing the conductive pins 17, 17 from slipping out of the housing 13 (housing plates 14, 14). Head sections of the conductive pins 17, 17 can protrude from the housing 13 (housing plates 14, 14).

The housing plates 14, 14 are assembled by aligning the through-holes 15, 15 on an opposite side from the small-diameter sections 16, 16 of the through-holes 15. This assembling may be conducted by adhesively bonding, welding, or clamping the housing plates 14, 14 together, or these components may be fixed with appropriate structure allowing them to be disassembled. Structure such as positioning pins and holes are preferably provided for convenience of assembling.

A coil spring 19 for causing the two conductive pins 17, 17 to protrude with a snap is inserted into the through-hole 15 of the housing 13 so as to mate with flange sections 18 of the conductive pins 17. The head sections of the conductive pins protrude to an exterior of the housing 13.

A shape and material of the housing 13, a number and arrangement of the through-holes 15 provided in the housing 13, and a material and shape of the coil spring 19 are identical to those of the embodiment illustrated by FIG. 1 and FIGS. 2A–2C and explanation thereof is not repeated herein.

A third embodiment of the pressure contact holding-type connector in accordance with the present invention will be described below.

Circuit boards or electronic components are disposed on both sides of the pressure contact holding-type connector, with a distance therebetween being reduced and electric connection being ensured by compressing the coil spring. In a case where operation of reducing the distance is eventually stopped by a conductive pin, coil spring, conductive plate, or the like, because those components are fabricated mainly from a good conductor, excess compression thereof can result in deformation or damage. In order to avoid this excess compression, it is preferred that an end stopper for prevention of excessive compression be provided in the pressure contact holding-type connector in accordance with the present invention between the housing and the circuit board or electronic component that are to be electrically connected.

A mode of providing the end stopper is, for example, as shown in FIGS. 5A–5D.

Figure 5A:
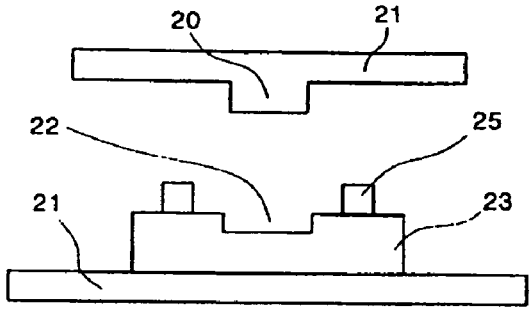
Figure 5B:
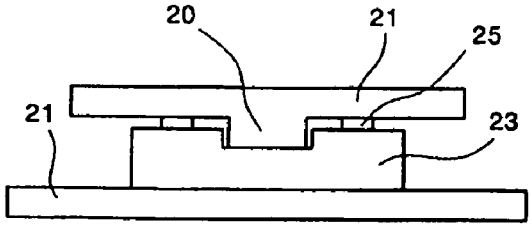

Protruding sections for reinforcement or the like are often present in circuit boards or electronic components. FIGS. 5A and 5B illustrate an example in which those protruding sections are used as end stoppers. Reference numeral 20 stands for a protruding section of a circuit board or an electronic component 21, and reference numeral 22 stands for a receding section provided in a housing 23 of a pressure contact holding-type connector. As shown in FIG. 5B, during mounting, the protruding section 20 of the circuit board or electronic component 21 and the receding section 22 provided in the housing 23 abut each other, thereby configuring an end stop.

Figure 5C:
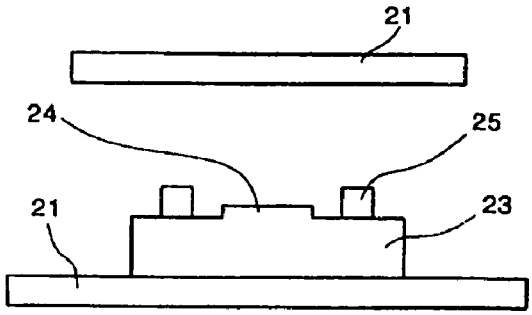
Figure 5D:
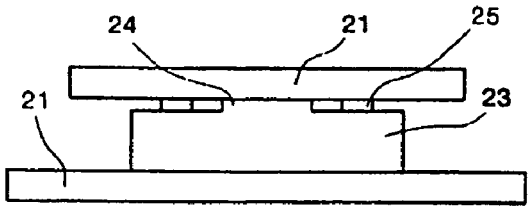

Furthermore, when the end stop is configured at a flat section of the circuit board or electronic component 21, as shown in FIG. 5C and FIG. 5D, protruding section 24, provided in the housing of the pressure contact holding-type connector, and the circuit board or electronic component 21 abut each other, thereby configuring the end stop. Reference numeral 25 stands for a conductive pin. In the example shown in FIGS. 5A–5D, the conductive pin has a flat head section.

A number, shape, and size of the receding sections 22 and protruding sections 24 can be appropriately selected.

A preferred modification example of the coil spring will be explained below.

The coil spring used in the pressure contact holding-type connector in accordance with the present invention may be formed to have an almost cylindrical shape, as described hereinabove, to facilitate fabrication thereof, but if the coil spring has an almost cylindrical shape, when it is compressed, in can be reduced in size only to an extent determined by contact of diameters of wire sections constituting the coil spring. Because of a demand for further miniaturization that was created in recent years, reduction, even if little, in height of the connector housing is needed. In order, to meet this demand, it is sometimes preferred that adjacent coil turns be formed to have mutually different diameters, without reducing an elastic constant.

Figure 6:
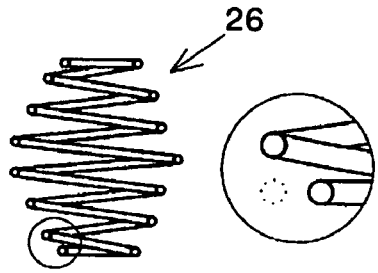
FIG. 6 is an explanatory drawing illustrating a preferred embodiment of a coil spring used in the pressure contact holding-type connector in accordance with the present invention.

Examples of coil springs 26 with a shape in which the adjacent coil turns have different diameters include a barrel-like coil shape with a larger diameter of a central portion thereof, as shown in FIG. 6, and an hourglass-like coil shape with a smaller diameter of a central portion thereof. As a result, as shown in an enlarged view on the right side of FIG. 6, a position of a wire turn located just above is shifted from a center of a wire turn located just below, as can be seen from a virtual projection circle shown by a dot line. A degree of this displacement is not limited to that of the example shown in FIG. 6 and can be set appropriately, for example, to less than half the diameter.

In the pressure contact holding-type connector in accordance with the present invention, various parts are vibration-aligned so as to be equidistantly accommodated in a special alignment jig. A final shape is formed by successive assembling.

Directionality of the conductive pin, conductive plate, and coil spring during alignment is determined by specific features of individual shapes, but establishing orientation of the housing is difficult.

Accordingly, directionality of a rear surface is revealed and alignment in the same direction is made possible by chamfering a corner in a direction of the rear surface of the housing, and providing receding portions of the same shape in an alignment jig.

Figure 7:
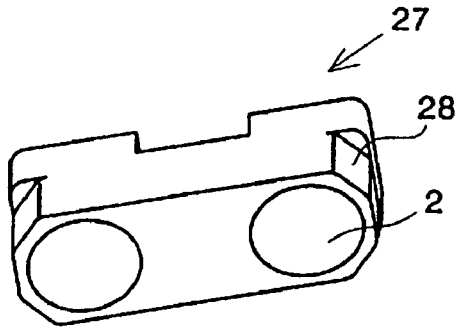
FIG. 7 is an explanatory drawing illustrating a preferred embodiment of a housing used in the pressure contact holding-type connector in accordance with the present invention.

FIG. 7 illustrates a preferred mode of chamfering corners on a lower side (a side faced by the conductive plate) of the housing. Thus, in the case illustrated by FIG. 7, chamfers 28 are provided at corner portions on a lower surface of housing 27 of the pressure contact holding-type connector.

In the example shown in FIG. 7, the chamfers are provided at all four inner corners, but because it is sufficient to distinguish only upper and lower surfaces of the housing, a size and number of the chamfers can be selected appropriately.

When the pressure contact holding-type connector in accordance with the present invention is mounted, usually, a solder paste is placed, for example, by using a printing technology onto a prescribed section such as an electrode portion of circuit board, the conductive plate of the pressure contact holding-type connector is brought into contact with the paste, and soldering is conducted with a reflow furnace or the like. In this case, a large spacing between conductive plates causes no problems, but in a case where only a spacing below a certain limit, for example, 0.2 mm (200 μm) can be provided, molten solder can flow, causing mutual contact and conduction (short circuiting).

Figure 8:
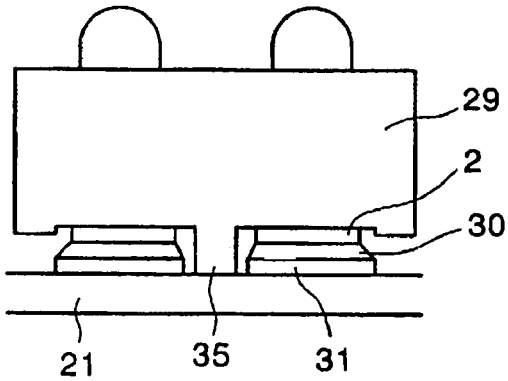
FIG. 8 is an explanatory drawing illustrating a fourth embodiment of the pressure contact holding-type connector in accordance with the present invention.

It is preferred that a rib for preventing the solder from wrapping-around be provided between the conductive plate of the housing so as to prevent contact between solder portions (short circuiting). As shown in FIG. 8, it is preferred that a rib 35 for preventing solder from wrapping-around be provided between conductive plates 2, 2 of housing 29 of the pressure contact holding-type connector in accordance with the present invention.

The rib for preventing the solder from wrapping-around is in principle a rib of a uniform width provided over an entire length of the housing, but a variety of modifications are possible, for example, the rib can be in the form of a cylindrical wall surrounding the conductive plate in its entirety. The rib for preventing the solder from wrapping-around preferably has a height equal to a total of a protrusion height of the conductive plate from the housing (for example, 0.065–0.085, μm), thickness of solder 30 (for example, 0.03–0.05 μm), and height of electrode 31 of a circuit board (for example, 0.035–0.055 μm) or a somewhat smaller height.

In the pressure contact holding-type connector in accordance with the present invention, the flange section of the conductive pin slides along the wall of the through-hole inside the through-hole provided in the housing. For this reason, the flange section is sometimes caught by the wall of the through-hole or these two members scratch against each other. A compression force acting upon the connector and required for mounting is preferably reduced to a minimum. Accordingly, in order to reduce sliding resistance or prevent scratching, it is preferred that corner portions of the flange section of the conductive pin be subjected to rounding.

Figure 9A:
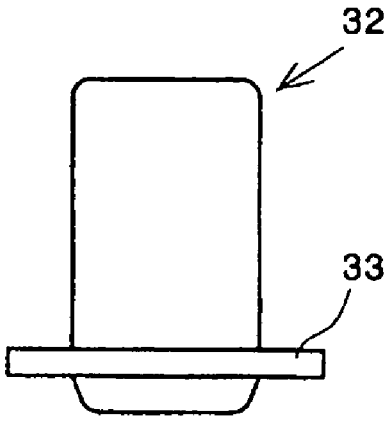
FIGS. 9A and 9B are explanatory drawings illustrating a preferred embodiment of a conductive pin used in the pressure contact holding-type connector in accordance with the present invention.
Figure 9B:
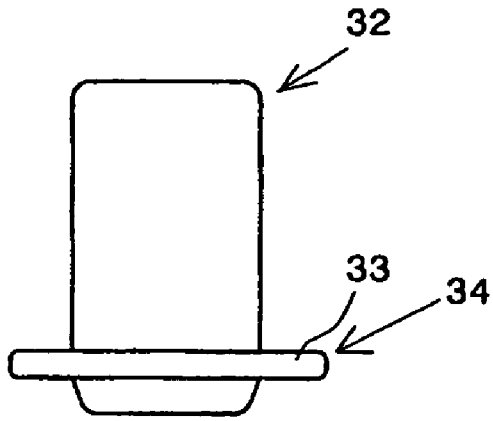
Figure 10:
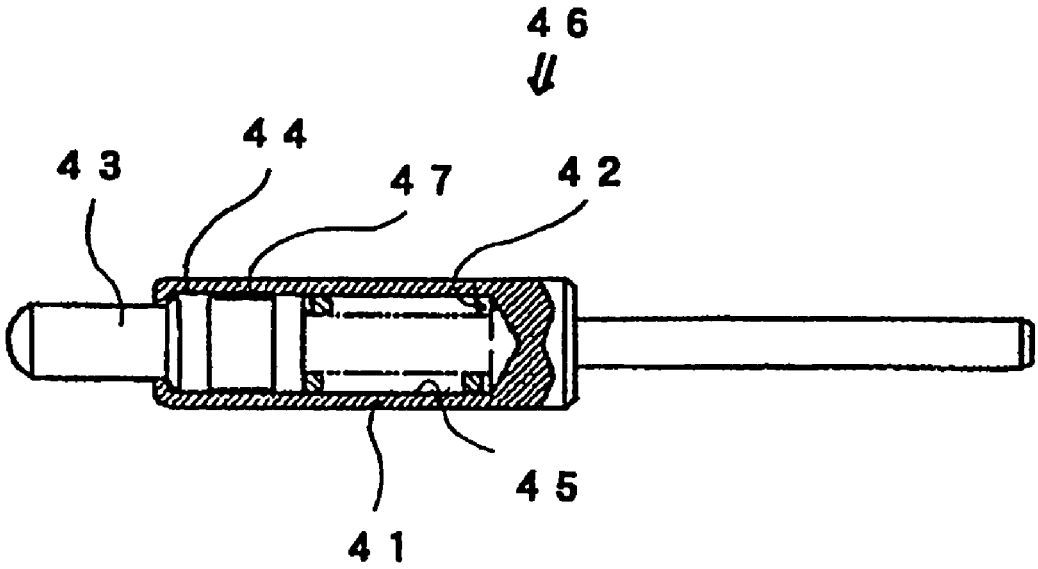
FIG. 10 (Prior Art)
FIG. 10 is an explanatory drawing illustrating a conventional connector pin for electric connection.
Figure 11:
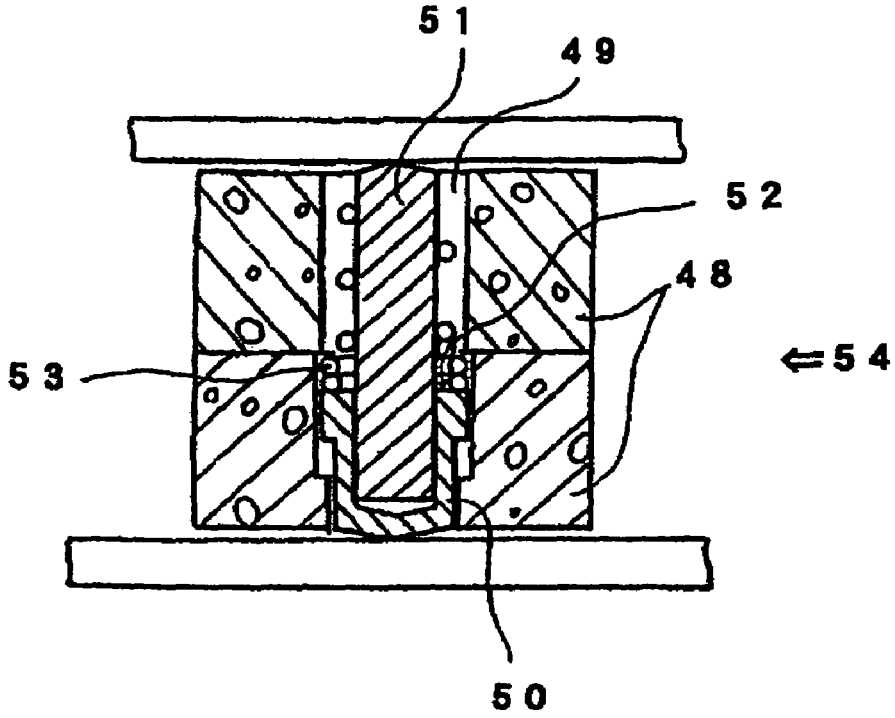
FIG. 11 (Prior Art)
FIG. 11 is an explanatory drawing illustrating a conventional pressure contact holding-type connector.
Figure 12:
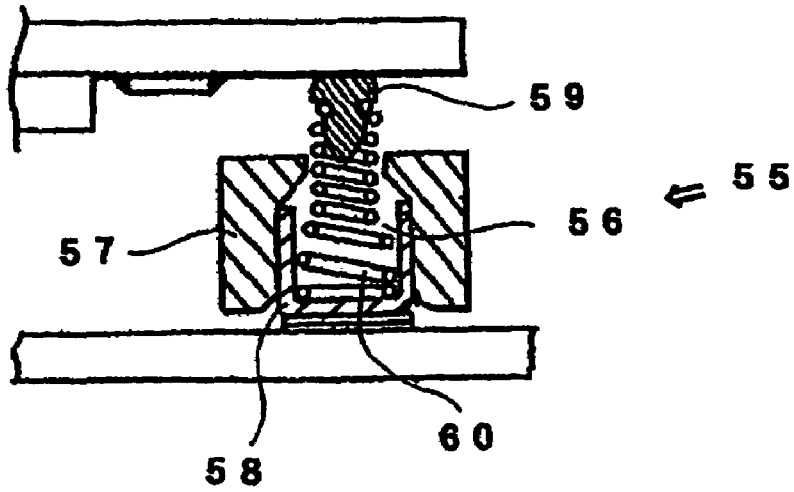
FIG. 12 (Prior Art)
FIG. 12 is an explanatory drawing illustrating a pressure contact holding-type connector of another conventional type.

As shown in FIG. 9, corner portions of flange section 33 of conductive pin 32 are preferably subjected to rounding work. This rounding can be implemented by a suitable working device such as a cutting, barreling, buffing, or electrolytic polishing device.

EXAMPLE

A fabrication example of the pressure contact holding-type connector in accordance with the present invention shown in FIG. 1 and FIGS. 2A–2C will be described below.

A housing having a length of 2 mm, width of 5 mm, and height of 2.1 mm was made from a polyamide resin. A conductive pin was fabricated from brass with gold plating. A coil spring was fabricated from a piano wire plated with a copper layer of a 4 μm thickness, then with a nickel layer of a 3 μm thickness and, as an outermost layer, with a gold layer of a 0.1 μm thickness, and had a wire diameter, pitch, and length (during assembling) of 0.1 mm, 0.4 mm, and 1.3 mm, respectively.

A stroke was 0.5 mm, a pushing load was 1 N per conductive pin, and electric resistance between connected electrodes was 0.2Ω per electrode pair.

INDUSTRIAL UTILITY

By virtue of successful accomplishment of compactness of connectors, great advantages are obtained in further and further progressing compactness and light-weightness of IT instruments such as mobile phones, PDAs and the like.

The invention claimed is:

1. A connector for interconnecting electrodes, comprising:

an insulating housing, said insulating housing having an inner surface defining within said insulating housing a through-hole having a large-diameter portion and a reduced-diameter portion;

a conductive pin having a contact portion; and a conductive coil spring mounted within said large-diameter portion of said through-hole and biasing said conductive pin such that said contact portion of said conductive pin is resiliently urged to protrude from said reduced-diameter portion of said through-hole, wherein at least one outer lower corner portion of said insulating housing is chamfered for cooperating with a corresponding portion in an alignment jig so as to align said insulating housing within the alignment jig.

2. The connector according to claim 1, wherein said inner surface includes a first portion extending in a thickness direction of said insulating housing, a second portion extending inwardly from said first portion at one end thereof, and a third portion extending from said second portion in the thickness direction of said insulating housing, such that said large-diameter portion of said through hole is defined by said first portion and said reduced-diameter portion is defined by said third portion, and said conductive pin also has a flange, with said conductive coil spring biasing said conductive pin such that said contact portion of said conductive pin is resiliently urged to protrude from said reduced-diameter portion of said through-hole by being in contact with said flange such that said flange is biased against said second portion to thereby maintain said conductive pin within said through-hole while said contact portion protrudes from said reduced-diameter portion of said through-hole.

3. The connector according to claim 2, wherein said inner surface further includes a fourth portion extending inwardly from said first portion at another end thereof, and a fifth portion extending from said fourth portion, in a direction opposite to the direction in which said third portion of said through-hole extends from said second portion of said through-hole, such that said fifth portion defines another reduced-diameter portion, and further comprising:

another conductive pin having a flange and a contact portion, with said conductive coil spring being in contact with said flange of said another conductive pin so as to bias said flange against said fourth portion to thereby maintain said another conductive pin within said through-hole while said another contact portion protrudes from said another reduced-diameter portion.

4. The connector according to claim 3, further comprising:

an end stop for preventing an excessive compressive force between a circuit board or an electronic component, to be electrically connected by the connector, and said insulating housing.

5. The connector according to claim 4, wherein adjacent coil turns of said conductive coil spring have different diameters.

6. The connector according to claim 5, further comprising:

a rib, on a lower surface of said insulating housing, for preventing solder on one side of said rib from contacting solder on an opposite side of said rib.

7. The connector according to claim 4, further comprising:

a rib, on a lower surface of said insulating housing, for preventing solder on one side of said rib from contacting solder on an opposite side of said rib.

8. The connector according to claim 3, further comprising:

a rib, on a lower surface of said insulating housing, for preventing solder on one side of said rib from contacting solder on an opposite side of said rib.

9. The connector according to claim 2, further comprising:

an end stop for preventing an excessive compressive force between a circuit board or an electronic component, to be electrically connected by the connector, and said insulating housing.

10. The connector according to claim 9, wherein adjacent coil turns of said conductive coil spring have different diameters.

11. The connector according to claim 10, further comprising:

a rib, on a lower surface of said insulating housing, for preventing solder on one side of said rib from contacting solder on an opposite side of said rib.

12. The connector according to claim 9, further comprising:

a rib, on a lower surface of said insulating housing, for preventing solder on one side of said rib from contacting solder on an opposite side of said rib.

13. The connector according to claim 2, wherein adjacent coil turns of said conductive coil spring have different diameters.

14. The connector according to claim 13, further comprising:

a rib, on a lower surface of said insulating housing, for preventing solder on one side of said rib from contacting solder on an opposite side of said rib.

15. The connector according to claim 2, further comprising:

a rib, on a lower surface of said insulating housing, for preventing solder on one side of said rib from contacting solder on an opposite side of said rib.

16. The connector according to claim 1, further comprising:

an end stop for preventing an excessive compressive force between a circuit board or an electronic component, to be electrically connected by the connector, and said insulating housing.

17. The connector according to claim 16, wherein adjacent coil turns of said conductive coil spring have different diameters.

18. The connector according to claim 1, wherein said inner surface further defines within said insulating housing another reduced-diameter portion, and further comprising:

another conductive pin having a contact portion, with said conductive coil spring biasing said another conductive pin, in a direction opposite to a direction in which said coil spring biases said conductive pin, such that said contact portion of said another conductive pin is resiliently urged to protrude from said another reduced-diameter portion of said through-hole.

19. The connector according to claim 1, wherein adjacent coil turns of said conductive coil spring have different diameters.

20. The connector according to claim 1, further comprising:

a rib, on a lower surface of said insulating housing, for preventing solder on one side of said rib from contacting solder on an opposite side of said rib.

* * * * *